US006401926B1

(12) United States Patent
Lo

(10) Patent No.: US 6,401,926 B1
(45) Date of Patent: Jun. 11, 2002

(54) CHILD-RESISTANT BLISTER PACKAGE

(75) Inventor: Julian B. Lo, Old Lyme, CT (US)

(73) Assignee: Pfizer Inc., New York, NY (US)

( * ) Notice: Subject to any disclaimer, the term of this patent is extended or adjusted under 35 U.S.C. 154(b) by 0 days.

(21) Appl. No.: 09/631,577

(22) Filed: Aug. 4, 2000

Related U.S. Application Data

(60) Provisional application No. 60/147,967, filed on Aug. 9, 1999.

(51) Int. Cl.[7] ..... B65D 83/04

(52) U.S. Cl. ..... 206/531; 206/468; 206/539; 229/72; 229/91

(58) Field of Search ..... 206/531, 532, 206/538, 539, 467–469; 221/69, 72, 89, 91, 302

(56) References Cited

U.S. PATENT DOCUMENTS

| | | | | |
|---|---|---|---|---|
| 3,089,590 A | * | 5/1963 | Mell | 206/467 |
| 3,387,699 A | | 6/1968 | Heller | |
| 3,503,493 A | | 3/1970 | Nagy | |
| 3,621,992 A | | 11/1971 | Osborne et al. | |
| 3,809,221 A | | 5/1974 | Compere | |
| 3,872,970 A | | 3/1975 | Edison | |
| 3,905,479 A | | 9/1975 | Gerner | |
| 3,921,805 A | | 11/1975 | Compere | |
| 4,216,860 A | | 8/1980 | Heimann | |
| 5,150,793 A | * | 9/1992 | Tannenbaum | 206/531 |
| 5,878,887 A | * | 3/1999 | Parker et al. | 206/531 |
| 6,047,829 A | * | 4/2000 | Johnstone et al. | 206/531 |
| 6,155,454 A | * | 12/2000 | George et al. | 206/531 |

FOREIGN PATENT DOCUMENTS

| | | |
|---|---|---|
| GB | 1576316 | 8/1980 |

* cited by examiner

*Primary Examiner*—Bryon P. Gehman
(74) *Attorney, Agent, or Firm*—Peter C. Richardson; Gregg C. Benson; Carl J. Goddard

(57) ABSTRACT

A child-resistant apparatus for dispensing articles which comprises a housing for retaining a blister package wherein the housing comprises a dispensing aperture; optionally, but preferably, a blister package comprising at least one blister cell containing an article to be dispensed; and a substantially rigid backing sheet substantially co-extensive with, and substantially blocking, the dispensing aperture, such that pressure exerted on an exposed top edge of the backing sheet imparts arcuate flexure thereto and dislocation thereof from the substantially co-extensive, and substantially blocking position, to a position where the dispensing aperture is unblocked permitting the at least one article contained in the at least one blister cell to be dispensed. Release of pressure on the exposed top edge of the backing sheet relaxes flexure thereof such that the substantially co-extensive, and substantially blocking position, wherein the backing sheet substantially blocks the dispensing aperture, is restored.

10 Claims, 5 Drawing Sheets

CHILD-RESISTANT BLISTER PACKAGE

This application is filed claiming priority from co-pending Provisional Application No. 60/147,967 filed Aug. 9, 1999.

BACKGROUND OF THE INVENTION

The pharmaceutical industry offers a diverse array of dispensers and containers for medications. While governmental regulations require child-resistant caps on bottles and vials containing pharmaceutical products, there exists a general need in the art for a device which is not only child-resistant, but also permits access to the medicaments or other articles contained therein to persons of diminished dexterity or cognitive function.

In recent years, blister packaging has become universally popular not only for medicaments in the form of capsules, pills or lozenges, but also for various electronic and automotive parts and the like. In a conventional blister package dispenser, the articles to be dispensed are sandwiched between a layer of transparent or translucent plastic in the form of a generally outwardly extending cavity or blister cell and a rupturable or puncturable layer. Force applied to the exterior of the outwardly extending blister cell, for example by the pressure of one or more fingers or the thumb of the individual dispensing the article, is transmitted to the article contained therein which subsequently ruptures or punctures the rupturable or puncturable layer. The article may then be removed or otherwise dispensed from the blister cell.

Because the contents of a blister package are generally visible and sometimes highly colored, they can become the targets of inquisitive children who risk substantial injury and/or death if they succeed in opening the package and ingesting or mishandling the contents thereof. Accordingly, it is important to childproof such packaging by rendering it too difficult to open for children while concurrently providing a user-friendly apparatus for use by adults who may be of diminished dexterity or digital function.

Childproof or child-resistant blister packages comprise a diversity of arrangements well-known to one of ordinary skill in the art. Certain of these incorporate so-called "tear-away" or "peel-away" backing strips designed to protect the contents of the blister package from contamination or unintended consumption by children. For example, U.S. Pat. No. 3,809,221 discloses a blister-type package comprising a flexible polymeric backing sheet covering a rupturable sheet of a medicament package. In such packaging, the pill or medicament cannot be forced through the rupturable sheet unless the backing sheet is first torn or peeled away. Other variations incorporating multiple "tear-away" backing sheets are found in U.S. Pat. Nos. 3,503,493; 3,621,992; and 3,387,699. Additional examples of such blister packages are disclosed in, inter alia, British Patent 1,576,316; U.S. Pat. Nos. 3,872,970; 3,905,479; 3,921,805; and 4,216,860. The disclosures of the aforementioned U.S. patents are all incorporated herein by reference.

Unfortunately, most of the aforementioned devices suffer from certain disadvantages attendant to "tear-away" or "peel-away" sealing means including progressively diminished integrity of the seal, stress-induced fatigue or wear of the sealing means following repeated opening and closing of the package, and difficulty of access to persons of diminished dexterity or physical ability. The present invention is directed to an improved, child-resistant blister package device which overcomes the disadvantages of the aforementioned prior art devices by providing an apparatus that optionally, but preferably, comprises a blister package retained in a housing having a dispensing aperture blocked by a substantially rigid backing sheet. The backing sheet initially occupies a position blocking the dispensing aperture of the housing. During of the apparatus, pressure exerted to an exposed top edge of the backing sheet imparts arcuate flexure thereto and dislocation thereof from blocking contact with the dispensing aperture of the housing, thereby permitting an article to be dispensed therethrough. Release of pressure on the top edge of the backing sheet relaxes flexure thereof and a firm block of the dispensing aperture by the backing sheet is restored. In contrast to the aforementioned prior art devices, diminished integrity of the seal and stress-induced fatigue or wear of the sealing means do not obtain from repeated manipulation of the device.

BRIEF DESCRIPTION OF THE DRAWINGS

For a more complete understanding of the invention, reference is now directed toward the embodiments illustrated in greater detail in the accompanying drawings and described hereinbelow by way of examples of the invention.

In the drawings.

REFERENCE NUMERALS IN THE DRAWINGS

Figure 1:
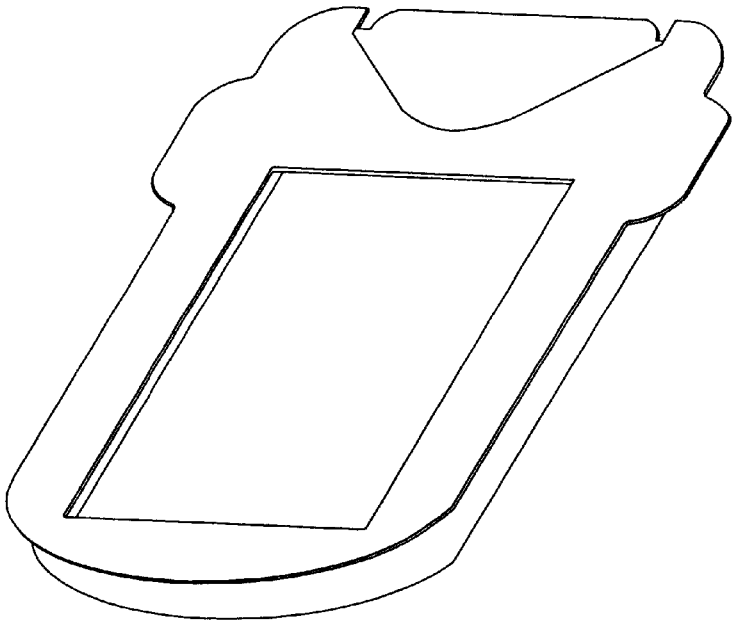
FIG. 1 is a perspective view of an embodiment of the apparatus.

1 housing
1*a* top
1*c* base
1*d* outer periphery
2 first sheet
2*a* first side
2*b* second side
3 blister cell
4 article
5 dispensing aperture
6 second sheet
6*a* first side
6*b* second side
7 parallel sidewall
8 top sidewall
8*a* bottom sidewall
9 detent means
10 backing sheet
11 top edge
12 bottom edge
13 side edge

14 detent engagement means

15 second detent engagement means

16 flexure enhancement means

SUMMARY OF THE INVENTION

The invention provides a child-resistant apparatus for dispensing articles which comprises a housing adapted to retain a blister package wherein the housing comprises a dispensing aperture, optionally, but preferably, a blister package comprising at least one blister cell containing an article to be dispensed, and a substantially rigid backing sheet substantially co-extensive with, and substantially blocking, the dispensing aperture, such that pressure exerted on an exposed top edge of the backing sheet imparts arcuate flexure thereto and dislocation thereof, from the substantially co-extensive, and substantially blocking position, to a position where the dispensing aperture is unblocked permitting the article contained in the blister cell to be dispensed as described hereinbelow. Release of pressure on the exposed top edge of the backing sheet relaxes flexure thereof such that the substantially co-extensive, and substantially blocking position, wherein the backing sheet substantially blocks the dispensing aperture, is restored.

DETAILED DESCRIPTION OF THE INVENTION

The instant invention provides an apparatus for dispensing articles which comprises a housing adapted to retain a blister package wherein the housing comprises an opening therein defining a dispensing aperture, a rear comprising a base, an outer periphery, and a detent means for engaging a detent engagement means on a substantially rigid backing sheet; optionally, but preferably, a blister package retained by the housing, wherein the blister package comprises at least one blister cell containing an article to be dispensed; and a substantially rigid backing sheet substantially co-extensive with, and substantially blocking, the dispensing aperture, wherein the backing sheet comprises an exposed top edge, a bottom edge attached to the rear of the housing, opposing side edges and a detent engagement means disposed in an operative relationship with the detent means on the housing.

Figure 2:
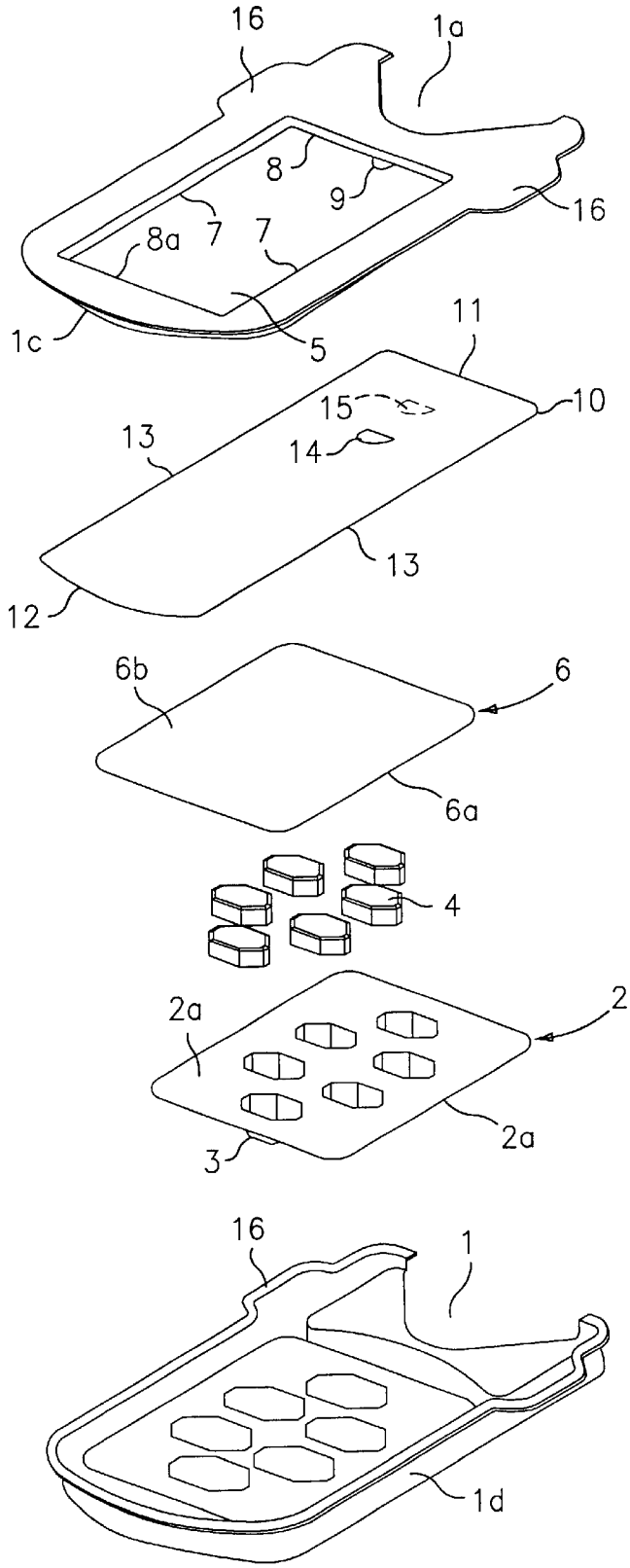
FIG. 2 is a fragmentary perspective of an embodiment of the apparatus.

The apparatus of the instant invention optionally, but preferably, comprises a conventional blister package unit that will be well known to one of ordinary skill in the art. In the practice of the instant invention, any desired shape or size blister package configuration may be employed. An exemplary package, substantially rectangular in shape, is depicted in fragmentary perspective in FIG. 2. As shown in FIG. 2, a conventional blister package typically comprises a first sheet 2 a second sheet 6, and articles 4 contained therein.

The first sheet 2 is formed from a generally compressible, formable material, preferably a clear, pre-formed polymeric or thermoplastic material such as polyvinyl chloride, polystyrene, polypropylene, polyethylene terephthalate (PET), polyethylene terephthalate glycol (PETG), or amorphous polyethylene terephthalate (APET), including laminates or co-extrusions thereof, which allows pressure applied to the first sheet 2 to be transmitted to the article 4 contained therein to remove the article 4 from the blister package.

It will be appreciated by one of ordinary skill in the art that alternative polymeric or similar materials different from those set forth hereinabove or any other generally compressible, moldable material may be employed in forming the first sheet 2 of the blister package. In general, the material comprising the first sheet 2 should be selected in accordance with the chemical and/or physical attributes of the articles to be contained therein. If desired, the first sheet 2 may comprise an opaque material, thereby preventing the article 4 contained therein from being viewed or attracting undesired attention. Furthermore, the first sheet 2 may comprise material of such density and opacity as to filter out degradative wavelengths of light, or to protect the articles 4 from inadvertent physical damage attendant to manipulation.

As shown in FIG. 2, the first sheet 2 has a first side 2*a* and a second side 2*b*. The first sheet 2 has at least one, but preferably a plurality of, generally outwardly extending blister cells 3 for accomodating the articles 4 to be dispensed. The dimensions of the blister cells 3 are generally complementary with respect to the size and shape of the articles 4 contained therein. The articles 4 contained in the blister cells 3 preferably comprise pharmaceutical or medicinal products, such as pills, tablets, capsules, syringes, suppositories, and the like. However, it is to be understood that the articles 4 need not be restricted to pharmaceutical or medicinal classifications, but may alternatively include electronic and automotive components, such as batteries, transistors, resistors, capacitors, screws, nuts, bolts or any other articles suitable for packaging in a blister-type package or container.

As shown in FIG. 2, the blister package further comprises a rupturable or puncturable substantially flat second sheet 6. The second sheet 6 is preferably puncturable by the article 4 contained within the area defined by the blister cell 3 when force is applied to an exterior portion of the blister cell 3 of the first sheet 2 and, thereby, to the article 4. One of ordinary skill in the art will appreciate that the pressure required to puncture the second sheet 6 with the article 4 is, inter alia, a necessary function of the shape and compressibility of the article 4, as well as the compressibility, thickness, and type of material from which the first sheet 2 and the second sheet 6 are formed. Normally, the required pressure is that which is capable of being generated by one or more fingers of an individual user of the apparatus.

One of ordinary skill in the art will understand that the second sheet 6 need not always be substantially flat, but may have ridges or indentations. Preferably, the second sheet 6 is generally co-extensive with, and conforms generally in size to, the first sheet 2. However, one of ordinary skill in the art will understand that the second sheet 6 may be larger or smaller than the first sheet 2, if desired.

As shown in FIG. 2, the second sheet 6 has a first side 6*a* and a second side 6*b*. The first side 6*a* of the second sheet 6 sealingly engages at least a portion of the first side 2*a* of the first sheet 2. The sealing engagement generally does not include the opening defined by the rear of the blister cell 3. Preferably, the first side 6*a* of the second sheet 6 is heat sealed or adhesively engaged to at least a portion of the first side 2*a* of the first sheet 2. For purposes of illustrative clarity, the adhesive or heat sealing coating is not shown, however, one of ordinary skill in the art will understand that the first side 6*a* of the second sheet 6 may be sealingly engaged with a portion of the first side 2*a* of the first sheet 2 by alternative means, such as induction heating, solvent welding, or other methods that will be known, or apparent in light of the disclosure herein, to one of ordinary skill in the art.

The first sheet 2 of the blister package is sealed by the second sheet 6 which serves to retain and protect the articles 4 while they are contained inside the blister cells 3. The second sheet 6 overlies the opening defined by the rear of the blister cell 3, is substantially co-extensive with the first sheet 2, and comprises a material that is generally rupturable or puncturable by the article 4 contained in the blister cell 3 when a force is applied to the outside of the blister. Preferably, the second sheet 6 comprises a metallic foil, such as aluminum foil or similar material, which is applied to the first sheet 2 in a manner such that a protective hermetic seal between the article 4 contained in the blister cell 3 and the exterior environment is imparted. It is to be understood, however, that any other conventional material, such as plastic or paper may be successfully employed.

Although the instant apparatus has been depicted in reference to a preferred blister package substantially rectangular in shape, in alternative embodiments of the invention, the blister package may be square, circular, or substantially circular in shape. In the square or substantially rectangular embodiments, the blister cell or cells may be disposed in any suitable or desirable arrangement about the blister package. In a circular or substantially circular embodiment, the blister package comprises at least one, but preferably a plurality of, blister cells preferably disposed evenly about an outer periphery of the blister package. One of ordinary skill in the art will readily appreciate that a conventional circular, or substantially circular, blister package is normally rotatably mounted in or on the housing about a common axis such that a blister cell, when depleted of the article contained therein, may be removed from alignment with the dispensing aperture of the housing by rotational movement of the blister package about the common axis. If desired, the blister package and/or the housing may further comprise alignment indices disposed on housing and/or the blister package that permit the user of the apparatus to correctly ascertain and align the relative positions of the blister cell or cells and the dispensing aperture.

The optional, but preferable, blister package is contained in a housing 1. For purposes of illustrative clarity and convenience, the housing depicted in FIG. 2 is shown as a two-piece arrangement comprising a separate top section 1*a* which, when assembled together with the housing 1, form an integral unit. It is to be understood, however, that the housing may comprise any conventional configuration suitable for retaining a blister package, including a single-piece design that does not incorporate a separate top section. The housing 1 of the instant invention is similar in appearance to a frame member and may be formed from a thermoplastic material such as polyvinyl chloride, styrene, polypropylene, or any of the other polymeric materials employed hereinabove to form the first sheet 2 of the blister package. However, one of ordinary skill in the art will understand that the housing may be formed from any material sufficiently rigid to retain and hold the blister package in place. For example, the housing can be constructed of paperboard or paperboard with a heat-seal coating or a combination of paperboard and a polymeric material. If the housing comprises an assembly of separate components comprising different materials, each or all of the components may be formed from the same material or different materials as desired. Preferably, the components of the housing are assembled by heat sealing, RF (radio frequency) or sonic welding, mechanical press fitting or other conventional means of assembly.

The components of the housing may be assembled after the blister package has been positioned inside the housing, or the housing may be designed as a pre-formed unit such that a blister package, acquired separately from the housing 1 but intended to be positioned therein by the user of the apparatus, may be removed therefrom when depleted of articles and replaced with a fresh blister package without necessitating the separate steps of dissassembly of the housing, removal of the depleted blister package, substitution thereof with a fresh blister package, and reassembly of the housing. If the housing 1 comprises such a pre-formed unit designed to be charged with a blister package acquired separately from the housing, one of ordinary skill in the art would understand that the apparatus should be designed so that the child-resistant attributes of the instant invention are retained. This may be accomplished by requiring, inter alia, that the level of strength and/or sophistication necessary to remove and replace the depleted blister package is such that only an adult would be able to perform the requisite operations.

Figure 3:
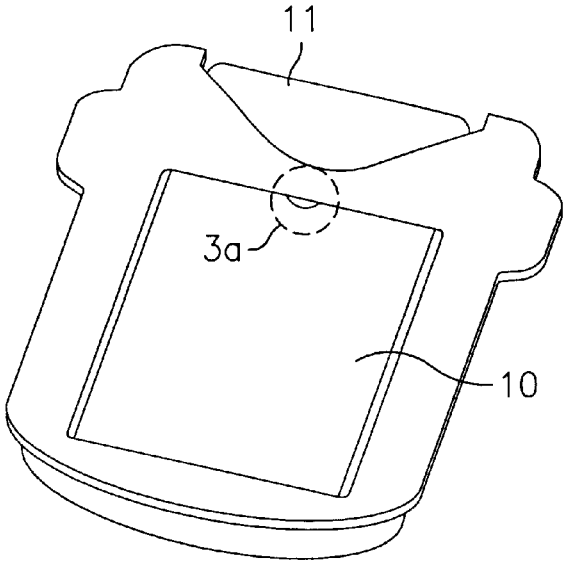
FIG. 3 illustrates an embodiment of the engagement between the detent means of the housing and the detent engagement means of the backing sheet.
Figure 3A:
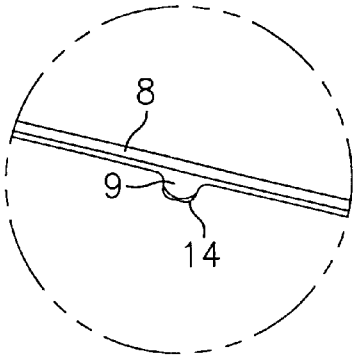

As depicted in FIG. 2, the housing 1 surrounds at least a portion of the optional, but preferable, blister package and is of appropriate shape and size to accomodate the blister package containing the articles 4 to be dispensed. The housing 1 further comprises an opening therein defining a dispensing aperture 5, which permits passage therethrough of the article 4 contained in the blister cell 3. It is to be understood that the dispensing aperture 5 may may be sized in a manner appropriate to accomodate the passage therethrough, and dispensation thereof, of a single article 4 or, if desired, multiple articles simultaneously. In the substantially rectangular embodiment depicted in FIG. 2, the dispensing aperture 5 comprises an opening defined by elongate, parallel sidewalls 7, perpendicular top sidewall 8 and bottom sidewall 8*a* in the top 1*a* of the rear of the housing 1. It is to be understood, however, that the embodiment of the dispensing aperture 5 depicted in FIG. 2, is for purposes of exemplification only, and that the dispensing aperture 5 may comprise any desired shape or size suitable for the passage therethrough, and dispensation thereof, of the article 4, and may be disposed at any appropriate or desired location in the housing 1. The housing 1 further comprises a detent means 9 for engaging a detent engagement means 14 on a substantially rigid backing sheet 10 that seals the dispensing aperture 5. As shown in FIG. 3, the engagement of the detent means 9 of the housing 1 and the detent engagement means 14 of the backing sheet 10 imparts a secure, child-resistant seal of the dispensing aperture 5 by the backing sheet 10, by precluding movement thereof, thereby preventing unintended manipulation of the apparatus resulting in the undesired dispensation of an article 4 from the blister cell 3. In the embodiment depicted in FIG. 2, the detent means 9 is disposed along the top sidewall 8 of the dispensing aperture 5 and comprises a downwardly-depending projection. However, it is to be understood that the detent means 9 of the housing 1 may comprise any conventional arrangement suitable for mechanically engaging the detent engagement means 14 of the backing sheet 10, including a notch or opening, a raised ridge, an indentation or groove, or a similar, or a different, means.

The apparatus further comprises a substantially rigid backing sheet 10 substantially co-extensive with, and substantially blocking, the dispensing aperture 5 of the housing 1, wherein the backing sheet 10 comprises an exposed top edge 11, a bottom edge 12 attached to the rear, preferably the base 1*c*, of the housing 1, opposing side edges 13, and a detent engagement means 14 disposed in an operative relationship with the detent means 9 of the housing 1. In the embodiment of the invention depicted in FIG. 2, the bottom edge 12 of the backing sheet 10 is attached to the base 1*c* of the rear of the housing 1 at the bottom sidewall 8*a* of the dispensing aperture 5. Any conventional means of attaching the bottom edge 12 of the backing sheet 10 to the rear, including the base 1*c,* of the housing 1 may be employed, including heat or sonic welding, mechanical press fitting, mechanical engagement utilizing a dovetail or tongue-in-groove joint, or a similar, or a different, means. The backing sheet 10 may be constructed of either transparent or opaque material, however, for reasons of operational security where children may be involved an opaque material is generally preferable. The types of materials that may be used to form the backing sheet 10 may include those polymeric materials employed hereinabove to form the first sheet 2 of the blister package. It is to be understood, however, that any suitable material may be employed to form backing sheet 10 which is substantially rigid, yet is of sufficient resilience to permit arcuate flexure of the backing sheet 10 upon the exertion of pressure to the exposed top edge 11 thereof, and relaxation thereof upon release of pressure to the exposed top edge 11 thereof. The backing sheet 10 further comprises a detent engagement means 14. As depicted in FIG. 2, the detent engagement means 14 preferably comprises an opening in, or through, the backing sheet 10, however, the detent engagement means 14 may comprise any conventional arrangement suitable for mechanically engaging with the detent means 9 of the housing 1, including a notch or opening, a raised ridge or projection, an indentation or groove, or a similar, or a different, means.

During normal operation of the apparatus, satisfactory results are obtained when the apparatus is manipulated as described hereinbelow. However, if desired where the operator is of significantly impaired ability, an alternative embodiment is disclosed, wherein the backing sheet 10 further comprises a second detent engagement means 15, shown in dotted outline in FIG. 2, disposed on the backing sheet 10 such that means for holding the backing sheet 10 in an open, flexed position relative to the dispensing aperture 5 is provided. Preferably, the second detent engagement means 15 is disposed slightly above the detent engagement means 14. As in the instance of the detent engagement means 14, the second detent engagement means 15 may comprise any conventional arrangement suitable for mechanically engaging with the detent means 9 of the housing 1. The second detent engagement means 15 may comprise an identical, a similar, or a different arrangement than that comprising the detent engagement means 14. As depicted in FIG. 2, the second detent engagement means 15 preferably comprises an opening in, or through, the backing sheet 10. The specific functional and operational aspects of the second detent engagement means 15 are detailed hereinbelow.

Figure 4:
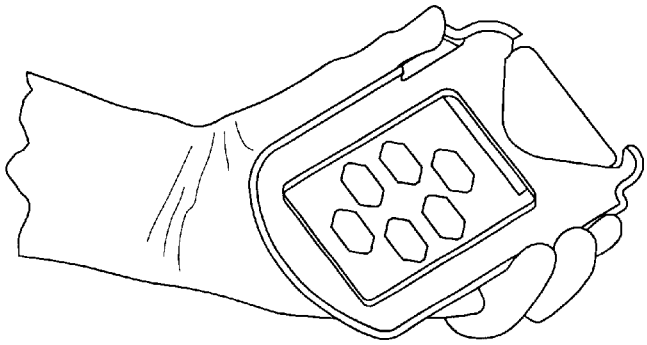
FIGS. 4 and 4a depict initial steps in the manipulation of an embodiment of the apparatus.
Figure 4A:
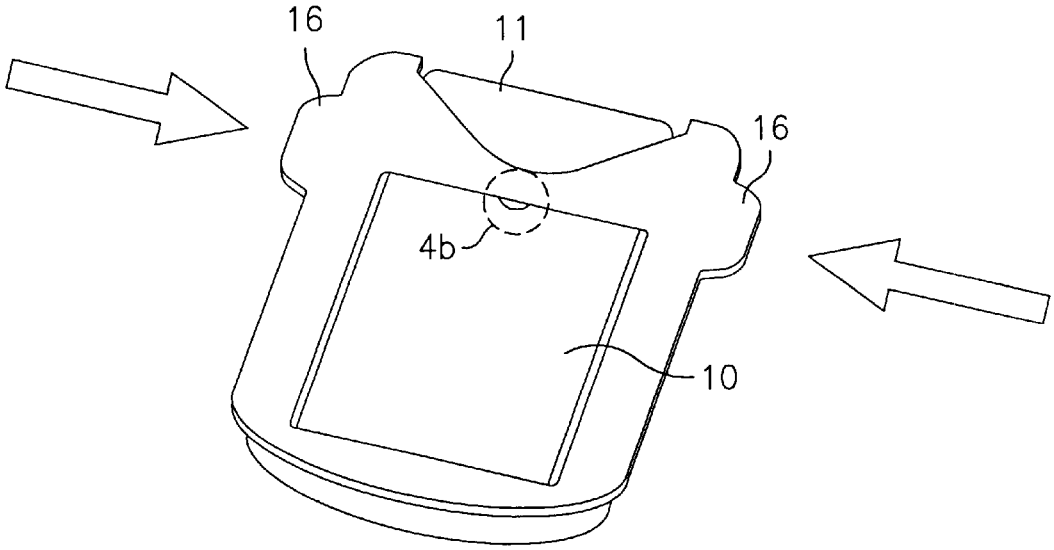
Figure 4B:
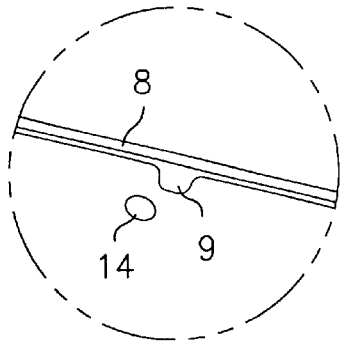

The embodiment of the invention shown in FIG. 2 may be manipulated as depicted in FIGS. 4, 4*a*, 5, and 5*a*. The apparatus is first positioned in a manner such that facile operation of the mechanism may be performed by the user thereof. This may be accomplished by preferably orienting the apparatus in the palm of the hand of the user with the dispensing aperture 5 facing upward. As depicted in FIG. 4, pressure is then exerted simultaneously, preferably by the thumb and middle finger of the user, on both sides of the outer periphery 1*d* of the housing 1 such that a slight arcuate flexure, as depicted in FIG. 4*a*, of the top sidewall 8 of the dispensing aperture 5 of the housing 1 is induced, resulting in disengagement of the detent means 9 and the detent engagement means 14. Although the process of imparting flexure is normally achieved by pressure exerted directly on both sides of the outer periphery 1*d* of the housing 1, it is sometimes preferable to aid users of impaired dexterity by providing a flexure enhancement means 16. As depicted in FIG. 2, the flexure enhancement means 16 may comprise a pair of diametrically opposed tabs disposed on the outer periphery 1*d* of the housing 1. If desired, the flexure enhancement means 16 may incorporate a grooved, serrated, reeded, or other similarly patterned surface to augment frictional contact between the flexure enhancement means 16 and the fingers of the user.

Figure 5:
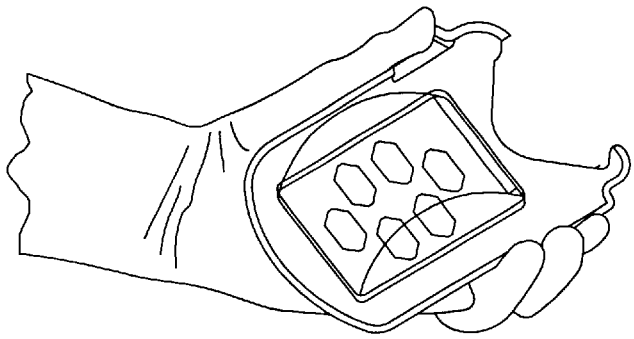
FIGS. 5 and 5*a* depict final steps in the manipulation of an embodimert of the apparatus.
Figure 5A:
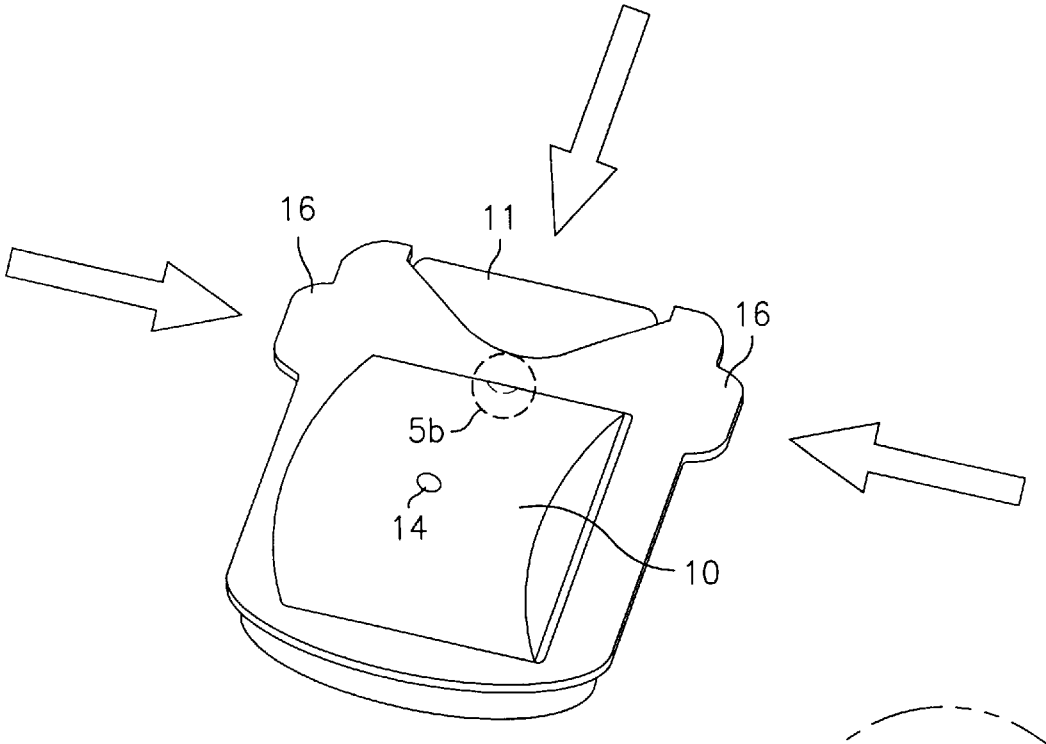
Figure 5B:
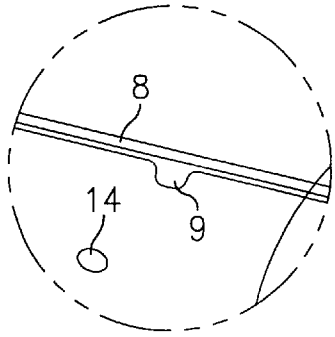

Once disengagement of the detent means 9 of the housing and the detent engagement means 14 of the backing sheet has been achieved, and pressure is maintained on both sides of the outer periphery 1*d* of the housing 1, pressure is then imparted to the exposed top edge 11 of the backing sheet 10, as depicted in FIGS. 5 and 5*a*, preferably through the action of the index finger, in a direction parallel to the opposing side edges 13 of the backing sheet 10, thereby imparting arcuate flexure thereto and dislocation thereof from the substantially co-extensive and substantially blocking position, to a position where the dispensing aperture 5 is unblocked. The article 4 contained in the blister cell 3 may now be dispensed as described hereinabove. Release of pressure on the exposed top edge 11 of the backing sheet 10, and release of pressure on both sides of the outer periphery 1*d* of the housing 1, relaxes flexure of the backing sheet 10 and the housing 1, resulting in restoration of the substantially co-extensive, and substantially blocking position, wherein the backing sheet 10 substantially blocks the dispensing aperture 5, and reengagement of the detent means 9 and the detent engagement means 14.

Figure 6:
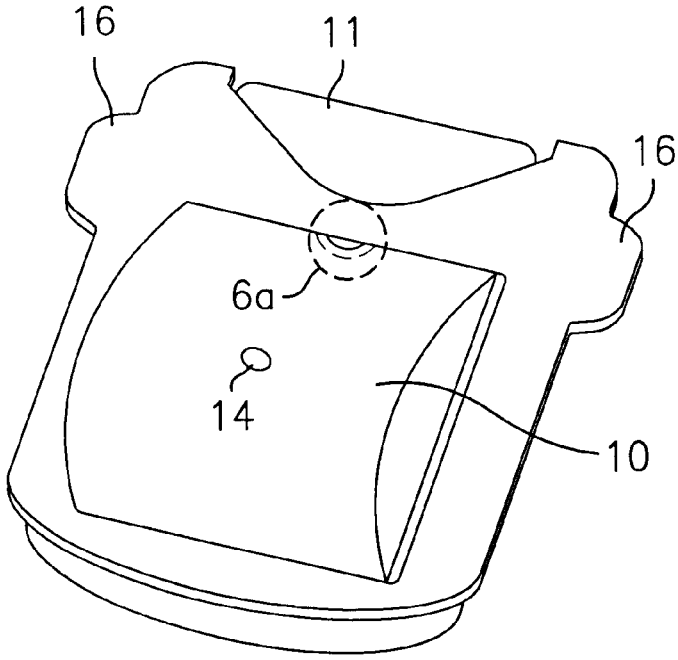
FIG. 6 depicts an embodiment of the engagement between the detent means of the housing and the second detent engagement means of the backing sheet.
Figure 6A:
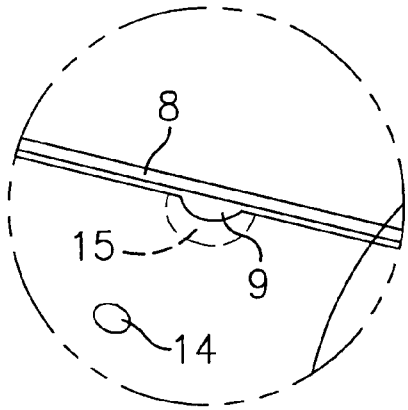

With respect to the embodiment of the invention depicted in FIG. 2, wherein the backing sheet 10 further comprises a second detent engagement means 15, once arcuate flexure of the backing sheet 10 has been achieved as described hereinabove, the second detent engagement means 15 is urged into engagement with the detent means 9 of the housing 1 by exertion of slight additional pressure to the exposed top edge 11 of the backing sheet 10 and release of pressure on the outer periphery 1*d* of the housing 1. When the pressure exerted on the exposed top edge 11 of the backing sheet 10 is subsequently released, the backing sheet 10 remains arcuately flexed, as shown in FIG. 6, and the dispensing aperture 5 remains unblocked. The article 4 contained in the blister cell 3 may now be dispensed as described hereinabove. The backing sheet 10 may be subsequently returned to the substantially co-extensive, and substantially blocking, position by once more exerting pressure simultaneously, preferably by the thumb and middle finger, on both sides of the outer periphery 1*d* of the housing 1 such that a slight arcuate flexure of the housing 1 occurs, resulting in disengagement of the detent means 9 of the housing 1 and the second detent engagement means 15 of the backing sheet 10, resulting in relaxation of flexure of the backing sheet 10 and subsequent reengagement of the detent means 9 and the detent engagement means 14.

It will be appreciated by one of ordinary skill in the art that, while the instant invention and the operational aspects thereof have been described hereinabove with respect to certain embodiments, other variations and modifications may also be made or incorporated thereunto without departing from the scope and spirit of the invention.

What is claimed is:

1. An apparatus for dispensing articles which comprises:

a housing for retaining a blister package, said housing having an opening therein defining a dispensing aperture, wherein said housing comprises a rear comprising a base, an outer periphery, and a detent means for engaging a detent engagement means on a substantially rigid backing sheet;

a blister package retained by said housing, wherein said blister package comprises at least one blister cell containing an article to be dispensed; and a substantially rigid backing sheet substantially co-extensive with, and substantially blocking said dispensing aperture, wherein said backing sheet comprises an exposed top edge, a bottom edge attached to said rear of said housing, opposing side edges and a detent engagement means disposed in an operative relationship with said detent means on said housing such that, pressure imparted to said outer periphery of said housing releases said detent means from engagement with said detent engagement means on said backing sheet;

pressure imparted to said exposed top edge of said backing sheet in a direction parallel to said opposing side edges of said backing sheet imparts arcuate flexure thereto and dislocation thereof from said substantially co-extensive, and substantially blocking position, to a position where said dispensing aperture is unblocked permitting at least one said article contained in said at least one blister cell to be dispensed therethrough; and release of pressure on said exposed top edge of said backing sheet relaxes flexure thereof such that said substantially co-extensive, and substantially blocking position, wherein said backing sheet substantially blocks said dispensing aperture, is restored.

2. An apparatus of claim 1 wherein said backing sheet further comprises a second detent engagement means such that when said detent means on said housing is engaged with said second detent engagement means of said backing sheet, and pressure on said exposed top edge of said backing sheet is released, said backing sheet remains arcuately flexed and said dispensing aperture remains unblocked.

3. An apparatus of claim 1 wherein said housing further comprises flexure enhancement means disposed on said outer periphery of said housing.

4. An apparatus of claim 3 wherein said flexure enhancement means comprises a pair of diametrically opposed tabs.

5. An apparatus of claim 4 wherein said flexure enhancement means comprise a patterned surface.

6. An apparatus of claim 1 wherein said blister package is square, or substantially rectangular, in shape.

7. An apparatus of claim 1 wherein said blister package is circular, or substantially circular, in shape.

8. An apparatus of claim 1 wherein said backing sheet is attached to said base of said rear of said housing.

9. A housing for retaining a blister package, said housing having an opening therein defining a dispensing aperture, wherein said housing comprises:

a rear comprising a base, an outer periphery, and a detent means for engaging a detent engagement means on a substantially rigid backing sheet; and a substantially rigid backing sheet substantially co-extensive with, and substantially blocking, said dispensing aperture wherein said backing sheet comprises an exposed top edge, a bottom edge attached to said rear of said housing, opposing side edges and a detent engagement means disposed in an operative relationship with said detent means on said housing such that, pressure imparted to said outer periphery of said housing releases said detent means from engagement with said detent engagement means on said backing sheet;

pressure imparted to said exposed top edge of said backing sheet in a direction parallel to said opposing side edges of said backing sheet imparts arcuate flexure thereto and dislocation thereof from said substantially co-extensive, and substantially blocking position, to a position where said dispensing aperture is unblocked; and release of pressure on said exposed top edge of said backing sheet relaxes flexure thereof such that said substantially co-extensive, and substantially blocking position, wherein said backing sheet substantially blocks said dispensing aperture, is restored.

10. An apparatus for dispensing articles which comprises:

a housing for retaining a blister package, said housing having an opening therein defined by elongate, parallel sidewalls, a perpendicular top sidewall and a bottom sidewall, which opening defines a dispensing aperture, wherein said housing comprises a rear comprising a base, an outer periphery comprising flexure enhancement means which comprise a pair of diametrically opposed tabs having a patterned surface, and a detent means for engaging a detent engagement means on a substantially rigid backing sheet wherein said detent means is disposed along said perpendicular top sidewall of said dispensing aperture;

a substantially rectangular blister package retained by said housing, wherein said blister package comprises at least one blister cell containing an article to be dispensed; and a substantially rigid backing sheet substantially co-extensive with, and substantially blocking, said dispensing aperture wherein said backing sheet comprises an exposed top edge, a bottom edge attached to said base of said rear of said housing, opposing side edges, and a detent engagement means disposed in an operative relationship with said detent means on said housing such that, pressure imparted to said flexure enhancement means of said housing releases said detent means from engagement with said detent engagement means on said backing sheet;

pressure imparted to said exposed top edge of said backing sheet in a direction parallel to said opposing side edges of said backing sheet imparts arcuate flexure thereto and dislocation thereof from said substantially co-extensive, and substantially blocking position, to a position where said dispensing aperture is unblocked permitting at least one said article contained in said at least one blister cell to be dispensed therethrough; and release of pressure on said exposed top edge of said backing sheet relaxes flexure thereof such that said substantially co-extensive, and substantially blocking position, wherein said backing sheet substantially blocks said dispensing aperture, is restored.

* * * * *